US011666958B2

(12) United States Patent
Gambino

(10) Patent No.: US 11,666,958 B2
(45) Date of Patent: Jun. 6, 2023

(54) REFLEX ANGLE CAPABLE TUBE BENDING SYSTEMS WITH CRANK ASSEMBLIES

(71) Applicant: Joseph Gambino, Sandy, OR (US)

(72) Inventor: Joseph Gambino, Sandy, OR (US)

(73) Assignee: Rogue Fabrication, LLC, Sandy, OR (US)

( * ) Notice: Subject to any disclaimer, the term of this patent is extended or adjusted under 35 U.S.C. 154(b) by 14 days.

(21) Appl. No.: 17/557,426

(22) Filed: Dec. 21, 2021

(65) Prior Publication Data

US 2022/0203423 A1 Jun. 30, 2022

Related U.S. Application Data

(60) Provisional application No. 63/131,143, filed on Dec. 28, 2020.

(51) Int. Cl.
*B21D 7/02* (2006.01)

(52) U.S. Cl.
CPC ..... *B21D 7/02* (2013.01)

(58) Field of Classification Search
CPC . B21D 7/00; B21D 7/02; B21D 7/022; B21D 7/024; B21D 7/03; B21D 7/04; B21D 7/08; B21D 7/085; B21D 9/07; B21D 9/073; B21D 9/05
See application file for complete search history.

(56) References Cited

U.S. PATENT DOCUMENTS 3,958,440 A * 5/1976 Sassak ..... B21D 7/022 72/321
4,063,441 A * 12/1977 Eaton ..... B21D 7/024 72/154
4,090,387 A 5/1978 Dubreuil
4,178,788 A * 12/1979 Zollweg ..... B21D 7/024 72/154
4,201,073 A 5/1980 Eaton
4,269,054 A 5/1981 Eaton
4,750,346 A 6/1988 Traub
4,938,047 A * 7/1990 Yogo ..... B21D 7/024 72/149

(Continued)

OTHER PUBLICATIONS

U.S. Appl. No. 17/542,168, filed Dec. 3, 2021; First Named Inventor: Joseph Gambino; Non-Final Office Action dated Oct. 6, 2022; 10 pages.

*Primary Examiner* — Teresa M Ekiert
(74) *Attorney, Agent, or Firm* — Mohr IP Law Solutions, PC

(57) ABSTRACT

Tube bending devices including a device actuator, a crank assembly, a bending die, and a clamp assembly. The crank assembly is mechanically coupled to the device actuator. The bending die is mechanically coupled to the crank assembly. The clamp assembly is operatively coupled to the bending die and secures the tube to the bending die. The device actuator selectively drives the crank assembly. In some examples, the crank assembly selectively rotates the bending die over at least 180 degrees. In some examples, the bending die includes an axle and the crank assembly includes a first link, a crank actuator, and a second link. The first link is pivotally coupled to the device actuator and coupled to the axle. The crank actuator is pivotally coupled to the first link. The second link is pivotally coupled to the crank actuator and coupled to the axle.

19 Claims, 12 Drawing Sheets

(56) References Cited

U.S. PATENT DOCUMENTS

| | | | |
|---|---|---|---|
| 6,976,378 | B2 | 12/2005 | Kobayashi |
| 7,269,988 | B2 | 9/2007 | Kobayashi |
| 7,380,430 | B1 | 6/2008 | Rusch |
| 7,743,636 | B2 | 6/2010 | Rusch |

* cited by examiner

REFLEX ANGLE CAPABLE TUBE BENDING SYSTEMS WITH CRANK ASSEMBLIES

CROSS REFERENCE TO RELATED APPLICATIONS

This application claims priority to U.S. Application, Ser. No. 63/131,143, filed on Dec. 28, 2020, which hereby incorporated by reference for all purposes.

BACKGROUND

The present disclosure relates generally to tube bending systems. In particular, reflex angle capable tube bending systems with crank assemblies are described.

Known tube bending systems are not entirely satisfactory for the range of applications in which they are employed. One challenge facing machine shops currently is bending tubes over requisite angles in as few operations as expeditiously and accurately as possible.

Especially challenging are jobs requiring tubes to be bent over large angles, such as 180 degrees or more, which is beyond the capability of many conventional tube bending systems. Many conventional tube bending systems are not capable of bending tubes over large angles in a single operation. For example, most existing tube bending systems are limited to bending tubes well below 90 degrees and require an operator to mechanically adjust the system to bend the tube further. As a result, machine shops using conventional tube bending systems must attempt to bend tubes over large angles in successive operations, which increases the time and labor needed for the job and increases the risk for introducing quality degrading bending errors.

Certain existing tube bending systems are capable of bending tubes over large angles in a single operation, such as chain or gear driven systems. However, chain and gear driven systems tend to be complex and prohibitively expensive for many machine shops. The excessive expense of these conventional systems can derive from the systems' complexity, maintenance requirements, duty ratings, materials and components, and interoperability with other tube bending assemblies. For example, existing tube bending systems that are capable of bending tubes over large angles in a single operation tend to not be compatible with mandrel assemblies that would help affordably reduce defects when bending tubes.

Thus, there exists a need for tube bending systems that improve upon and advance the design of known tube bending systems. Examples of new and useful tube bending systems relevant to the needs existing in the field are discussed below.

Disclosure relevant to the tube bending systems described herein is provided in U.S. Pat. Nos. 4,269,054, 4,201,073, 7,269,988, 6,976,378 7,743,636, 7,380,430, and 4,750,346. The complete disclosures of these listed patents are herein incorporated by reference for all purposes.

SUMMARY

The present disclosure is directed to tube bending devices including a device actuator, a crank assembly, a bending die, and a clamp assembly. The crank assembly is mechanically coupled to the device actuator. The bending die is mechanically coupled to the crank assembly. The clamp assembly is operatively coupled to the bending die and secures the tube to the bending die. The device actuator selectively drives the crank assembly. In some examples, the crank assembly selectively rotates the bending die over at least 180 degrees. In some examples, the bending die includes an axle and the crank assembly includes a first link, a crank actuator, and a second link. The first link is pivotal coupled to the device actuator an coupled to the axle. The crank actuator is pivotally coupled to the first link. The second link is pivotally coupled to the crank actuator and coupled to the axle.

DETAILED DESCRIPTION

Figure 1:
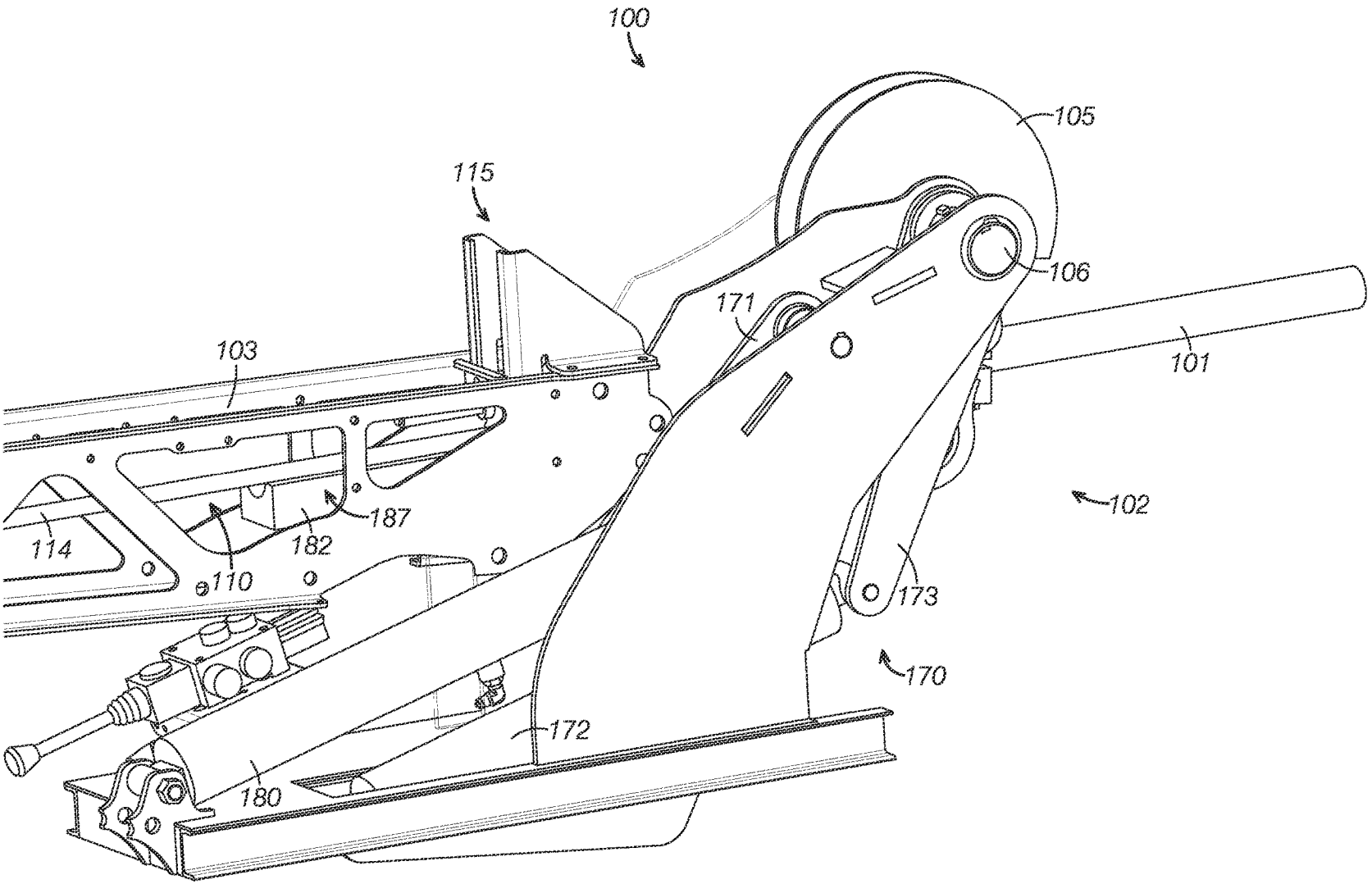
FIG. 1 is a side perspective view of a first example of a tube bending system.

The disclosed tube bending systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various tube bending systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

"Communicatively coupled" means that an electronic device exchanges information with another electronic device, either wirelessly or with a wire-based connector, whether directly or indirectly through a communication network.

"Controllably coupled" means that an electronic device controls operation of another electronic device.

Reflex Angle Capable Tube Bending Systems with Crank Assemblies

With reference to the figures, reflex angle capable tube bending systems with crank assemblies now be described. The tube bending systems discussed herein function to bend tubes over reflex angles; that is, over angles of 180 degrees or more in a single operation. Some examples of the tube bending systems discussed in this application are operable to bend tubes 225 degrees or more in a single operation. The novel tube bending systems described below are also capable of bending tubes by approximately −2 degrees, that is, in the opposite direction of the ultimate bend, for loading purposes.

The reader will appreciate from the figures and description below that the presently disclosed tube bending systems address many of the shortcomings of conventional tube bending systems. For example, the novel tube bending systems discussed herein are capable of bending tubes over large angles, including 180 degrees or more, in a single operation. Accordingly, the novel tube bending systems below are faster, less labor intensive, and reduce the chance of quality reducing errors that result from conventional tube bending that must bend tubes in successive operations to achieve large bend ranges. Unlike conventional tube bending systems with limited single operation bending ranges, the novel tube bending systems below do not require an operator to mechanically adjust the system to bend the tube further subsequent bending operations.

The novel tube bending systems discussed herein also improve over existing tube bending systems that are capable of bending tubes over large bending angles in a single operation. Unlike chain or gear driven systems, which tend to be complex and prohibitively expensive for many machine shops, the novel systems in this document are significantly more cost effective. The novel systems avoid the excessive expense of conventional systems by being less complex, requiring less maintenance, utilizing less expensive materials and components, and/or being more interoperable with other tube bending assemblies. For example, the novel systems discussed herein are compatible with mandrel assemblies that help affordably reduce defects when bending tubes.

Contextual Details

Ancillary features relevant to the tube bending systems described herein will first be described to provide context and to aid the discussion of the tube bending systems.

Tube

The tube bending systems described below are used to bend tubes. One example of a tube, tube 101, is depicted in the figures.

Tube 101 is an elongate member bent to defined parameters by the tube bending systems described below. The reader should understand that the tube need not be tubular in all examples. For example, the tube bent by the tube bending systems described herein may be a solid bar, a shaft, or a rod. For simplicity, this disclosure discusses in detail only tubular tubes, but the tube bending systems described herein should be understood to bend other elongate members beyond tubular tubes as well, such as solid bars.

The elongate member may be any currently known or later developed type of elongate member. The reader appreciate that a variety of elongate member types exist and could be used in place of the tube shown in the figures. In addition to the types of elongate members existing currently, it is contemplated that the tube bending systems described herein could bend new types of elongate members developed in the future.

The size of the tube may be varied as needed for a given application. In some examples, the tube is larger relative to the other components than depicted in the figures. In other examples, the tube is smaller relative to the other components than depicted in the figures. Further, the reader should understand that the tube and the other components may all be larger or smaller than described herein while maintaining their relative proportions.

The tube may be any of a wide variety of currently known or later developed metals and effectively bent by the tube bending systems described below. Suitable tube materials include carbon steels (1010, 1020, 1026, and 4130 steel), stainless steels, aluminum (6061 and 6063 up to T6 temper), titanium in CWSR (cold worked stress relieved) and annealed condition (2.5AL-3V, CP2, others), as well as copper and its alloys.

Tube Bending System Embodiment One

With reference to FIGS. 1-11, a first example of a tube bending system, tube bending system 100, will now be described. Tube bending system 100 functions to bend tube 101 over 225 degrees or more in a single operation. Other tube bending systems may bend tubes to greater or smaller degrees, such as up to 180 degrees, 220, degrees, or 260 degrees or more, including bending amounts in between, such as 181 degrees, 182 degrees, etc.

As can be seen in FIGS. 1-11, tube bending system 100 includes a tube bending device 102, a frame 103, a wiper die assembly 115, and a mandrel assembly 110. In other examples the tube bending system includes fewer components than depicted the figures, such as not including a wiper die assembly and/or a mandrel assembly. In certain examples, the tube bending system includes additional or alternative components than depicted in the figures, such as an extension frame and/or a lubrication system.

Tube Bending Device

Tube bending device 102 serves to bend a tube into a desired shape. In the present example, with reference to FIGS. 1-11, tube bending device 102 is configured to bend tube 101 at least 225 degrees in a single operation.

With reference to FIGS. 1-11, tube bending device 102 is mounted to frame 103. As shown in FIGS. 1-11, tube bending device 102 includes a bending die 105, a device actuator 180, a clamp assembly 183, a pressure die assembly 187, and a crank assembly 170.

Bending Die

As shown in FIGS. 1-7, bending die 105 cooperates with pressure die assembly 187, clamp assembly 183, crank assembly 170, and device actuator 180 to bend tube 101 when device actuator 180 rotates bending die 105. The reader can see in FIGS. 1-7 that tube 101 is fixed to bending die 105 by clamp assembly 183.

As shown in FIGS. 1-8, bending die 105 is circular and includes a curved outer circumference around which tube 101 bends as bending die 105 rotates. The curved shape of bending die 105 is configured to impart bends into tube 101 when device actuator 180 rotates bending die 105 and tube 101, in turn, is pulled over and around bending die 105. As can be seen in FIG. 1-8 bending die 105 includes an axle 106 coupled to crank assembly 170.

Figure 5:
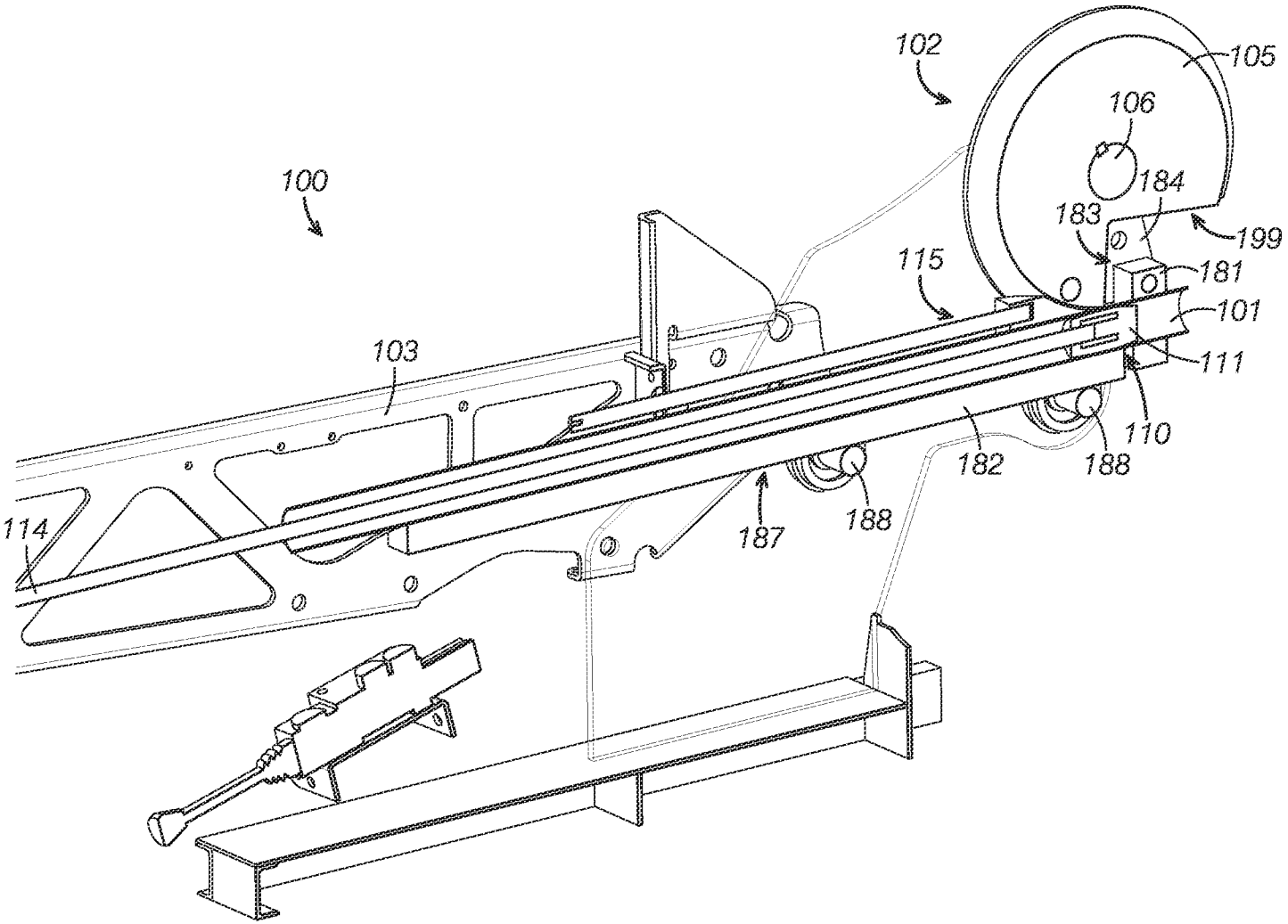
FIG. 5 is a sectional view of the tube bending system shown in FIG. 1 in the start position.
Figure 6:
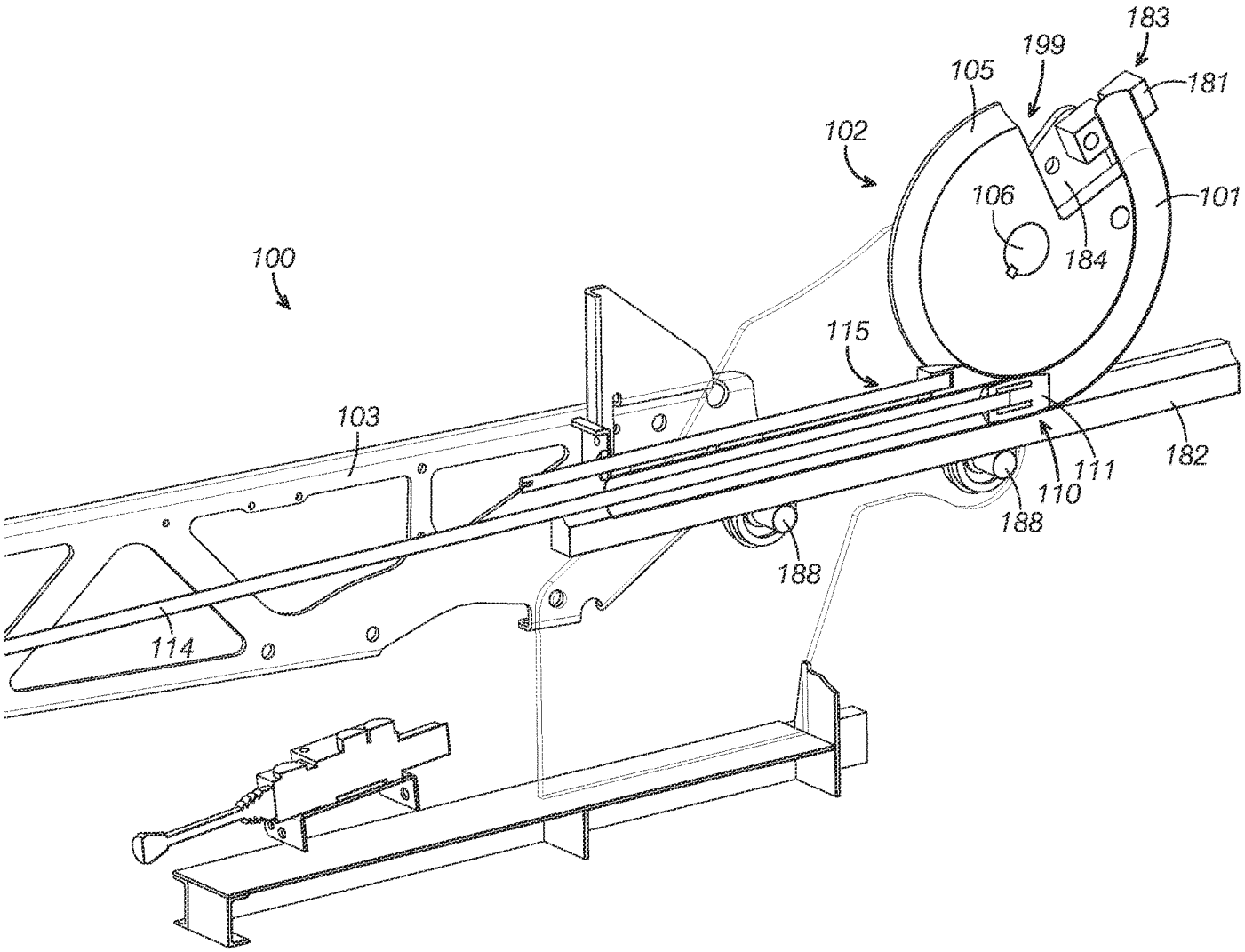
FIG. 6 is a sectional view of the tube bending system shown in FIG. 1 in the intermediate position.
Figure 7:
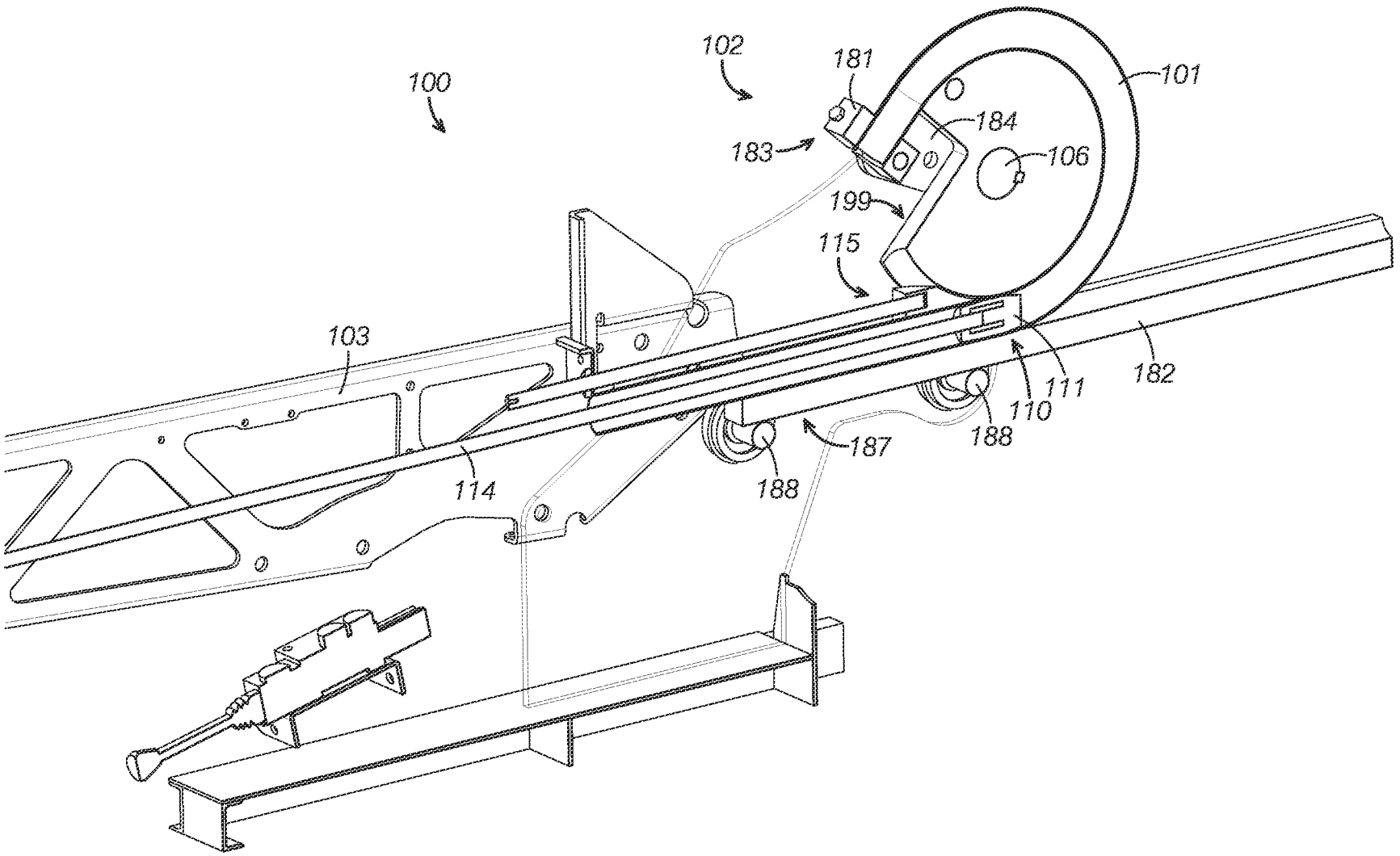
FIG. 7 is a sectional view of the tube bending system shown in FIG. 1 in the finished position.
Figure 8:
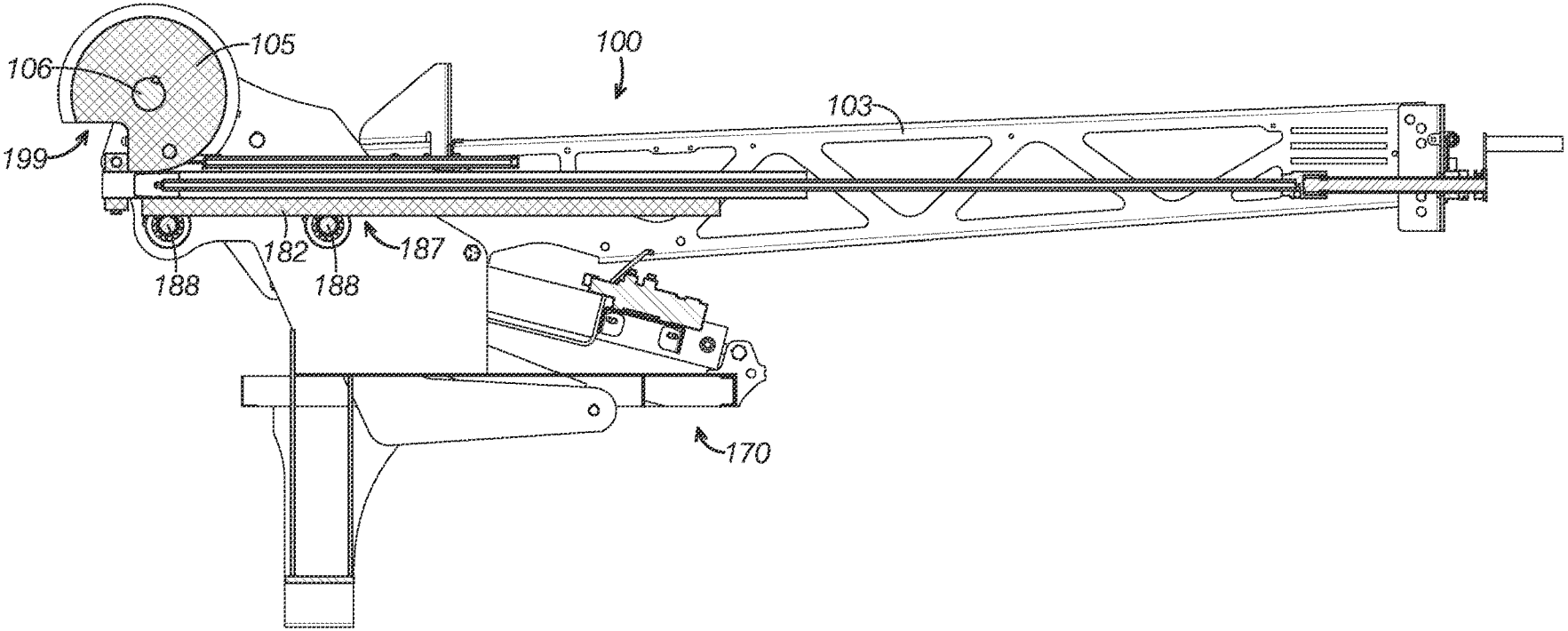
FIG. 8 is a side elevation section view of the tube bending system shown in FIG. 1.
Figure 9:
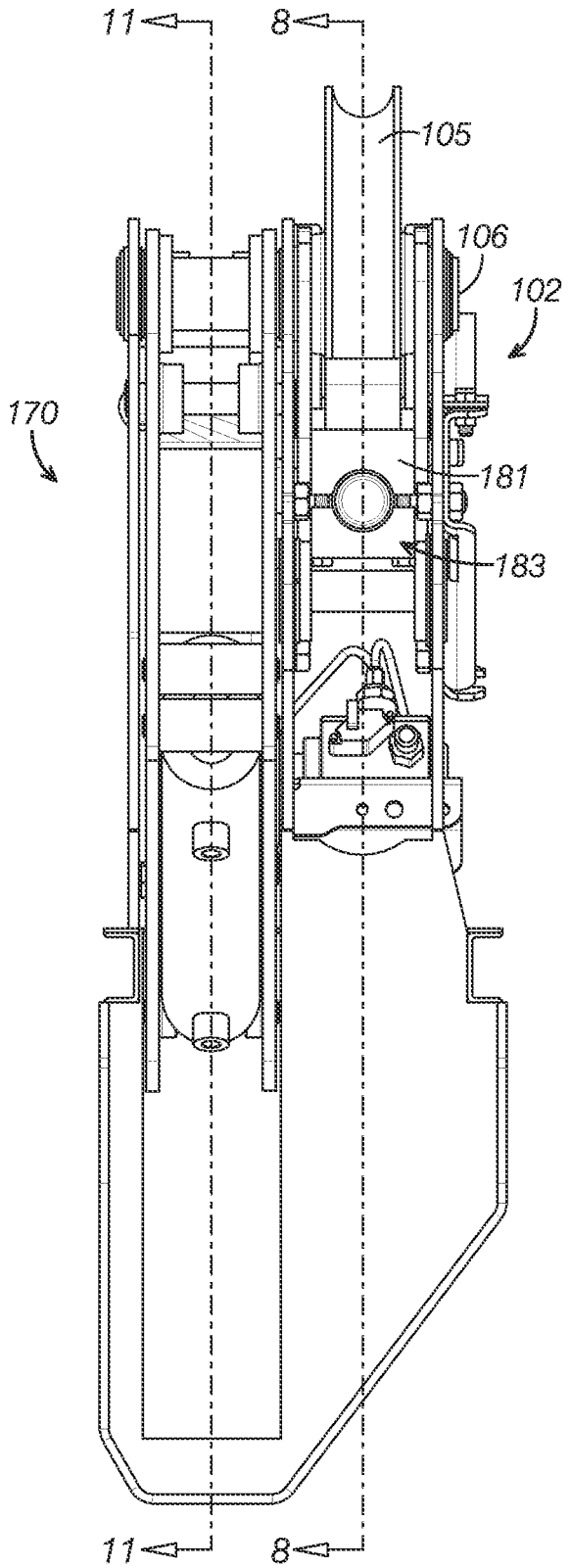
FIG. 9 is a front elevation view of the tube bending system shown in FIG. 1.
Figure 10:
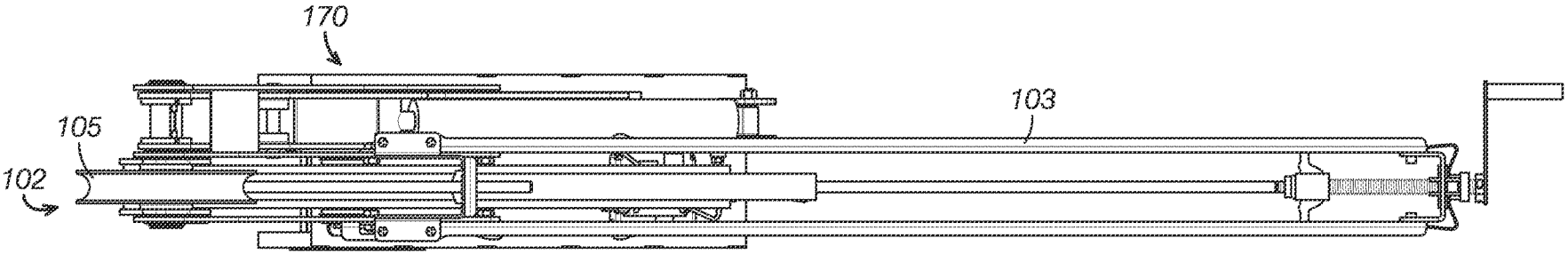
FIG. 10 is a top view of the tube bending system shown in FIG. 1.
Figure 11:
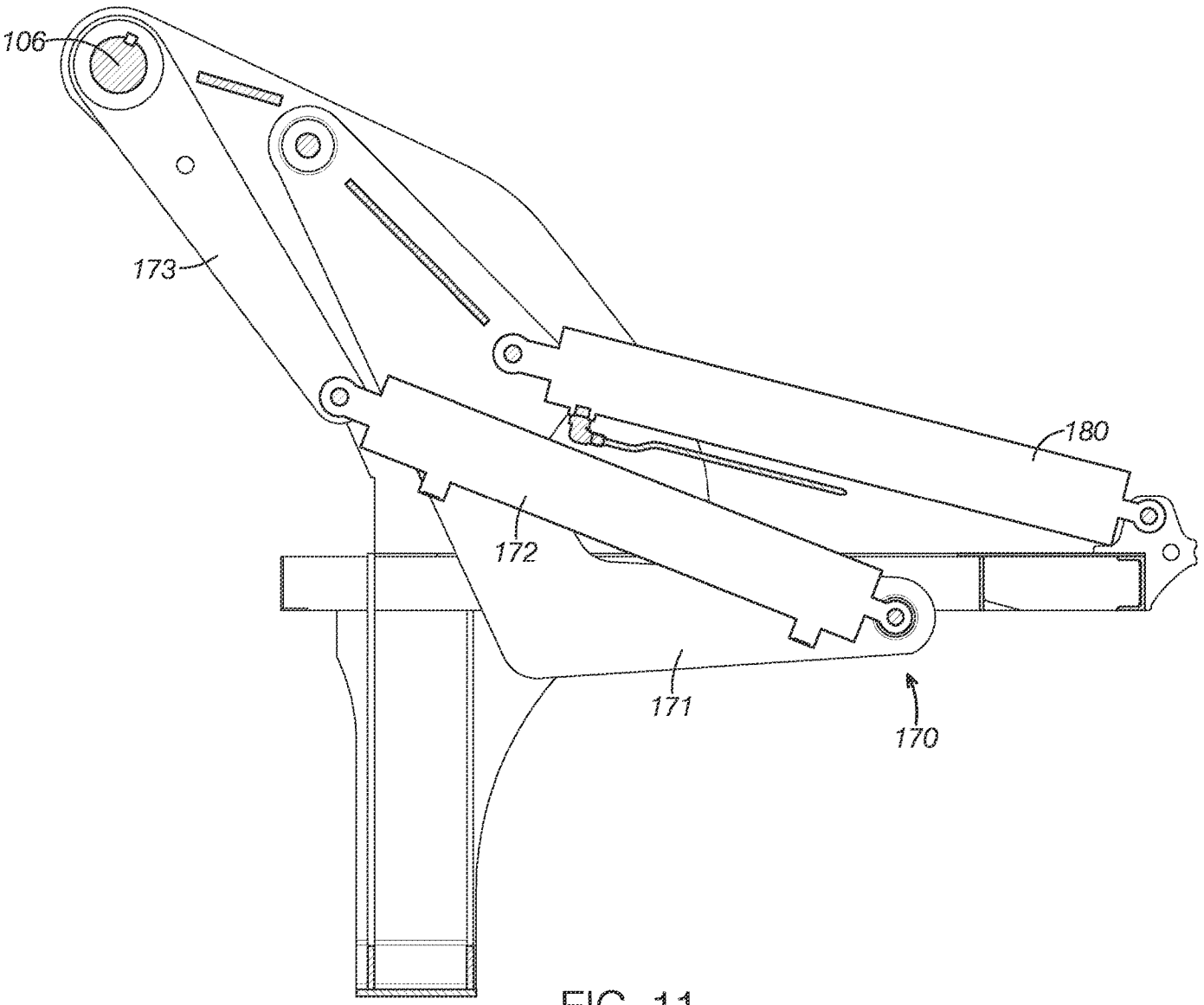
FIG. 11 is a side elevation section view of a tube bending device of the tube bending system shown in FIG. 1.

As can be seen in FIGS. 3 and 5-8, bending die 105 is a partial circle and defines a missing circle portion 199 when viewed from an axis about which bending die 105 rotates. As shown in FIGS. 5-7, clamp 181 and link plate 184 of clamp assembly 183 couple together in missing circle portion 199. In the particular example shown in the figures, the curved outer circumference of bending die 105 has a central angle of 270 degrees. Accordingly, the partial circle is approximately three quarters of a full circle and missing circle portion 199 is approximately one quarter of a full circle.

The size of the bending die be varied as needed for a given application. In some examples, the bending die is larger relative to the other components than depicted in the figures. In other examples, the bending die is smaller relative to the other components than depicted in the figures. Further, the reader should understand that the bending die and the other components may all be larger or smaller than described herein while maintaining their relative proportions.

The bending die may be any currently known or later developed type of bending die. The reader will appreciate that a variety of bending die types exist and could be used in place of the bending die shown in the figures. In addition to the types of bending dies existing currently, it is contemplated that the tube bending systems described herein could incorporate new types of rending dies developed in the nature.

In the present example, the bending die is composed of metal. However, the bending die may be composed of any currently known or later developed material suitable for bending tubes. Suitable materials include metals, polymers, ceramics, wood, and composite materials.

Device Actuator

As shown in FIGS. 1-4 and 8-11 device actuator 180 functions to rotate bending die 105 via crank assembly 170. The reader can see in FIGS. 1-4 that device actuator 180 selectively drives crank assembly 170. With tube 101 fixed to bending die 105 via clamp assembly 183, device actuator 180 rotating bending die 105 pulls tube 101 over and around bending die 105.

The size of the device actuator may be varied as needed for a given application. In some examples, the device actuator is larger relative to the other components than depicted in the figures. In other examples, the device actuator is smaller relative to the other components than depicted in the figures. Further, the reader should understand that the device actuator and the other components may all be larger or smaller than described herein while maintaining their relative proportions.

In the present example, device actuator 180 is a linear actuator. In particular, device actuator 180 is a hydraulic ram. However, the device actuator may be any currently known or later developed type of actuator, such as electric linear actuators, pneumatic actuators power screws, or combinations of actuators, rams, and/or screws. The reader will appreciate that a variety of ram or actuator types exist and could be used in place of the hydraulic ram shown in the figures. In addition to the types of rams and actuators existing currently, it is contemplated that the tube bending systems described herein could incorporate new types of rams or actuators developed in the future.

Clamp Assembly

As shown in FIGS. 3-11, clamp assembly 183 functions to fix tube 101 to bending die 105. In the example shown in the figures, clamp assembly 183 includes a link plate 184 and a clamp 181. With reference to FIGS. 2-5, the reader can see that link plate 184 is coupled to bending die 105.

FIGS. 3 and 5-7 depict that clamp 181 is coupled to link plate 184 partially in missing circle portion 199 of bending 105. As can be seen in FIGS. 2-5, clamp 181 is disposed proximate a terminal end of the curved outer circumference of bending die 105 when coupled to link plate 184.

Clamp assembly 183 cooperates with bending die 105, pressure die assembly 187, and device actuator 180 to bend tube 101 when device actuator 180 rotates bending die 105. Tube 101 being clamped to bending die 105 with clamp assembly 183 causes tube 101 to be pulled over and around bending die 105 when device actuator 180 rotates bending die 105.

The size of the clamp may be varied as needed for a given application. In some examples, the clamp is larger relative to the other components than depicted in the figures. In other examples, the clamp is smaller relative to the other components than depicted in the figures. Further, the reader should understand that the clamp and the other components may all be larger or smaller than described herein while maintaining their relative proportions.

The clamp may be any currently known or later developed type of clamp. The reader will appreciate that a variety of clamp types exist and could be used in place of the clamp shown in the figures. In addition to the types or clamps existing currently, it is contemplated that the tube bending systems described herein could incorporate new types of clamps developed in the future.

In the present example, the clamp is composed of metal. However, the clamp may be composed of any currently known or later developed material suitable for securing tubes. Suitable materials include metals, polymers, and composite materials.

Pressure Die Assembly

As shown in FIGS. 1-11, pressure die assembly 187 functions to support tube 101 against bending die 105. Pressure die assembly 187 cooperates with bending die 105, clamp assembly 183, crank assembly 170, and device actuator 180 to bend tube 101 when device actuator 180 rotates bending die 105.

In the present example, pressure die assembly 187 includes a pressure die 182 and rotating shafts 188. In other examples, the pressure die assembly includes additional or alternative components.

In the present example, as depicted in FIGS. 1-11, pressure die 182 translates over rotating shafts 188 in line with the longitudinal axis of tube 101 as bending die 105 bends tube 101. In other examples, the pressure die is fixed and does not translate. Pressure die 182 translating reduces tube wall thinning and improves the quality of the resulting bend by reducing or removing tension in tube 101 when bending it.

As shown n FIGS. 5-11, pressure die 182 is supported on two rotating shafts mounted on bearings, which are supported on frame 103. The two rotating shafts mounted on bearings define rotating shafts 188. Rotating shafts 188 are configured to freely rotate as pressure die 182 translates to facilitate pressure die 182 translating.

In the present example, pressure die 182 translates by being pulled forward by tube 101 as tube 101 is pulled around pressure die 105. Pressure die 182 frictionally engages tube 101. In other examples, the pressure die translates by various additional or alternative means. For example, the pressure die translates by pneumatics, hydraulics, a motor, a screw, gears, or a chain. In some examples, the pressure die exerts forward translational force on tube 101, sometimes referred to as a boost, to improve bend quality and reduce wall thinning.

The size of the pressure die assembly may be varied as needed for a given application. In some examples, the pressure die assembly is larger relative to the other components than depicted in the figures. In other examples, the pressure die assembly is smaller relative to the other components than depicted in the figures. Further, the reader should understand that the pressure die assembly and the other components may all be larger or smaller than described herein while maintaining their relative proportions.

The pressure die assembly may be any currently known or later developed type of pressure die system. Suitable alternatives include static systems, such as a rotating round pressure die or a static friction pressure die. The reader will appreciate that a variety of pressure die system types exist and could be used in place of the pressure die assembly shown in the figures. In addition to the types of pressure dies systems existing currently, it is contemplated that the tube bending systems described herein could incorporate new types of pressure die systems developed in the future.

In the present example, the pressure die is composed of metal. However, the pressure die may be composed of any currently known or later developed material suitable for supporting tubes. Suitable materials include metals, polymers, ceramics, wood, and composite materials.

In the present example, the pressure die defines a curved channel to complement the round outer profile of tube 101. However, the shape of the channel defined by the pressure die and the overall shape of the pressure die may be varied to suit the needs of a given application. For example, some pressure dies define rectilinear channels when the tubes being bent are square or rectilinear.

Crank Assembly

As shown FIGS. 1-11, crank assembly 170 serves to convert linear motion from device actuator 180 into rotational motion acting on bending die 105 in a two-stage actuation process. Crank assembly 170 is coupled to device actuator 180 on an input end and to axel 106 of bending die 105 on an output end. Crank assembly 170 is further pivotally coupled to frame 103.

In the present example, crank assembly 170 includes a first link 171, a crank actuator 172, and a second link 173. However, the crank assembly may include more or fewer links and/or actuators as needed to effectuate a desired manner of linear to rotational motion conversion. Each component of crank assembly 170 is pivotally connected to one another.

Figure 3:
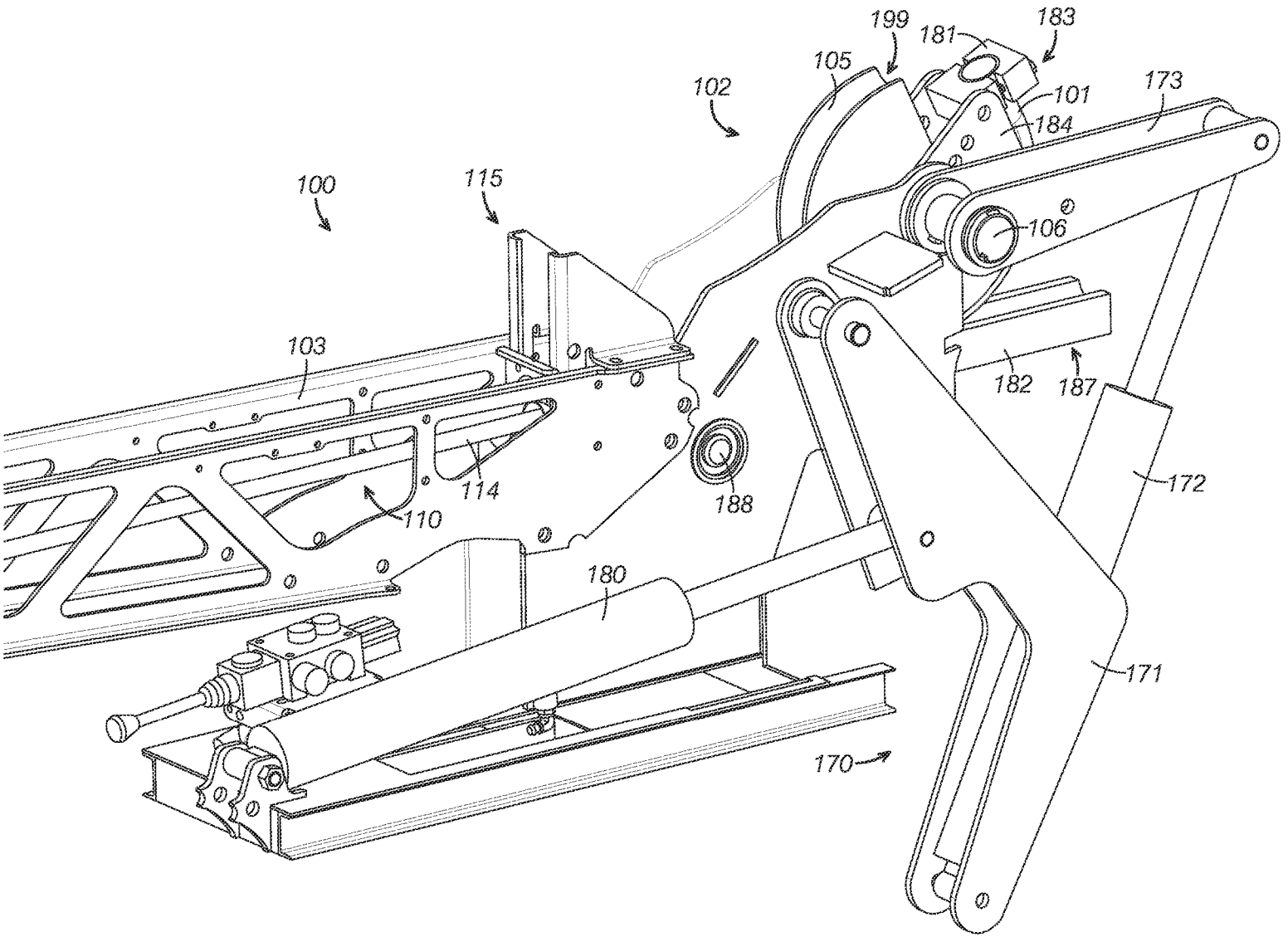
FIG. 3 is a side perspective view of the tube bending system shown in FIG. 1 in an intermediate position.
Figure 4:
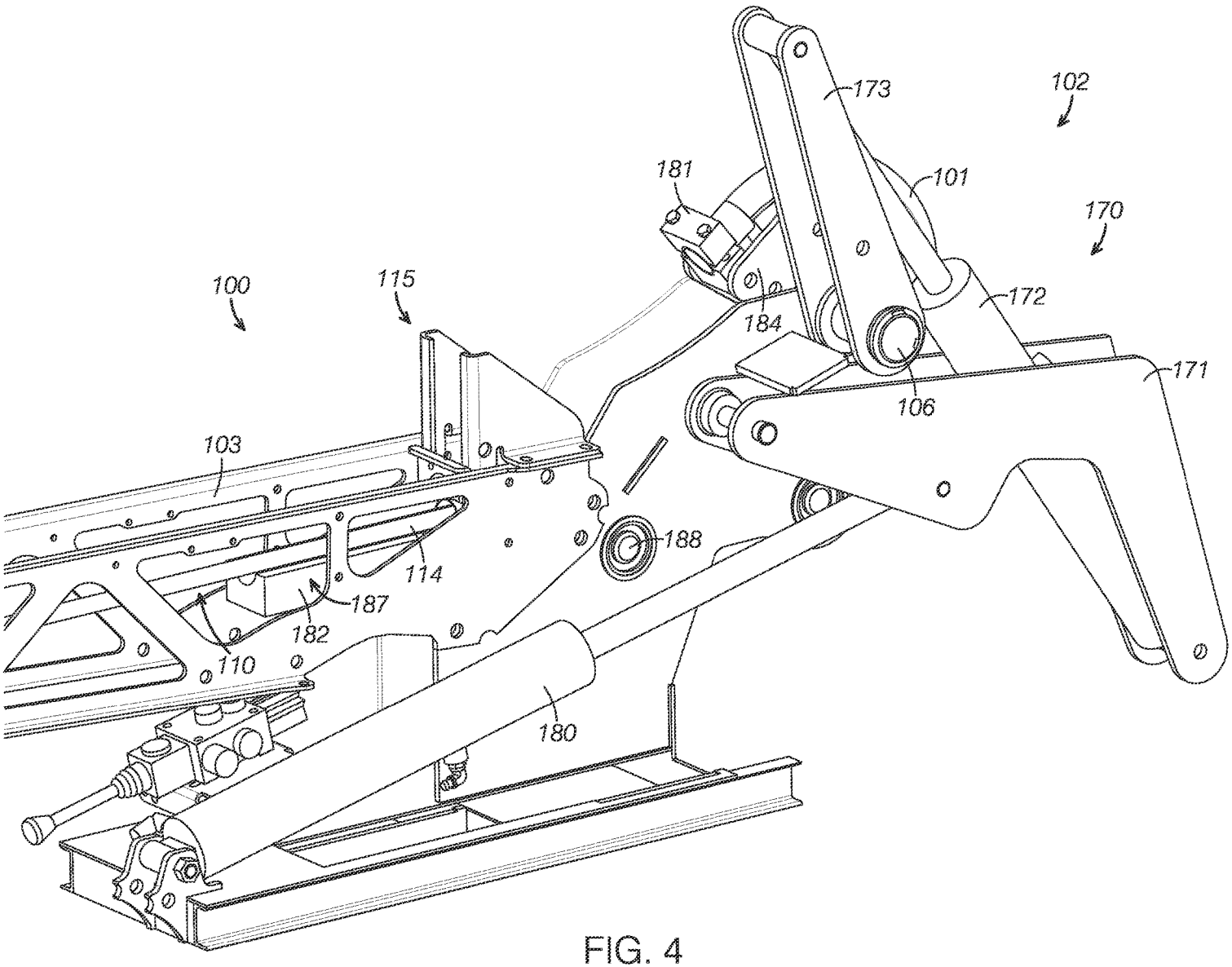
FIG. 4 is a side perspective view of the tube bending system shown in FIG. 1 in a finished position.

As shown in FIGS. 3 and 4, first link 171 is pivotally connected to frame 103, to crank actuator 172, and to device actuator 180. As can be seen in FIGS. 3 and 4, first link 171 pivotally couples to device actuator 180 between where first link 171 is pivotally coupled to frame 103 and where first link 171 is pivotally coupled to crank actuator 172.

Figure 2:
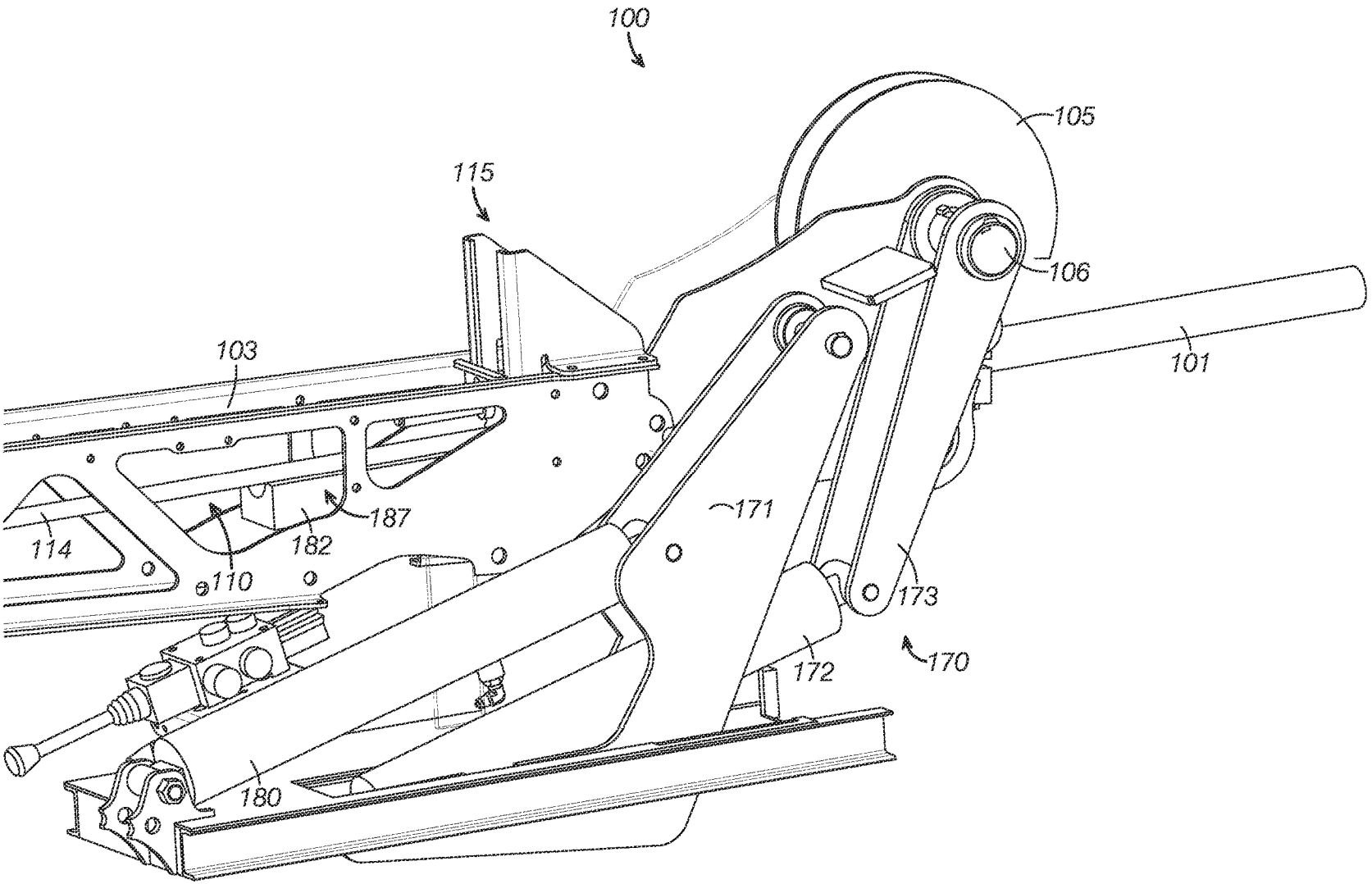
FIG. 2 is a side perspective view of the tube bending system shown in FIG. 1 in a start position and with a cover removed.
Figure 12:
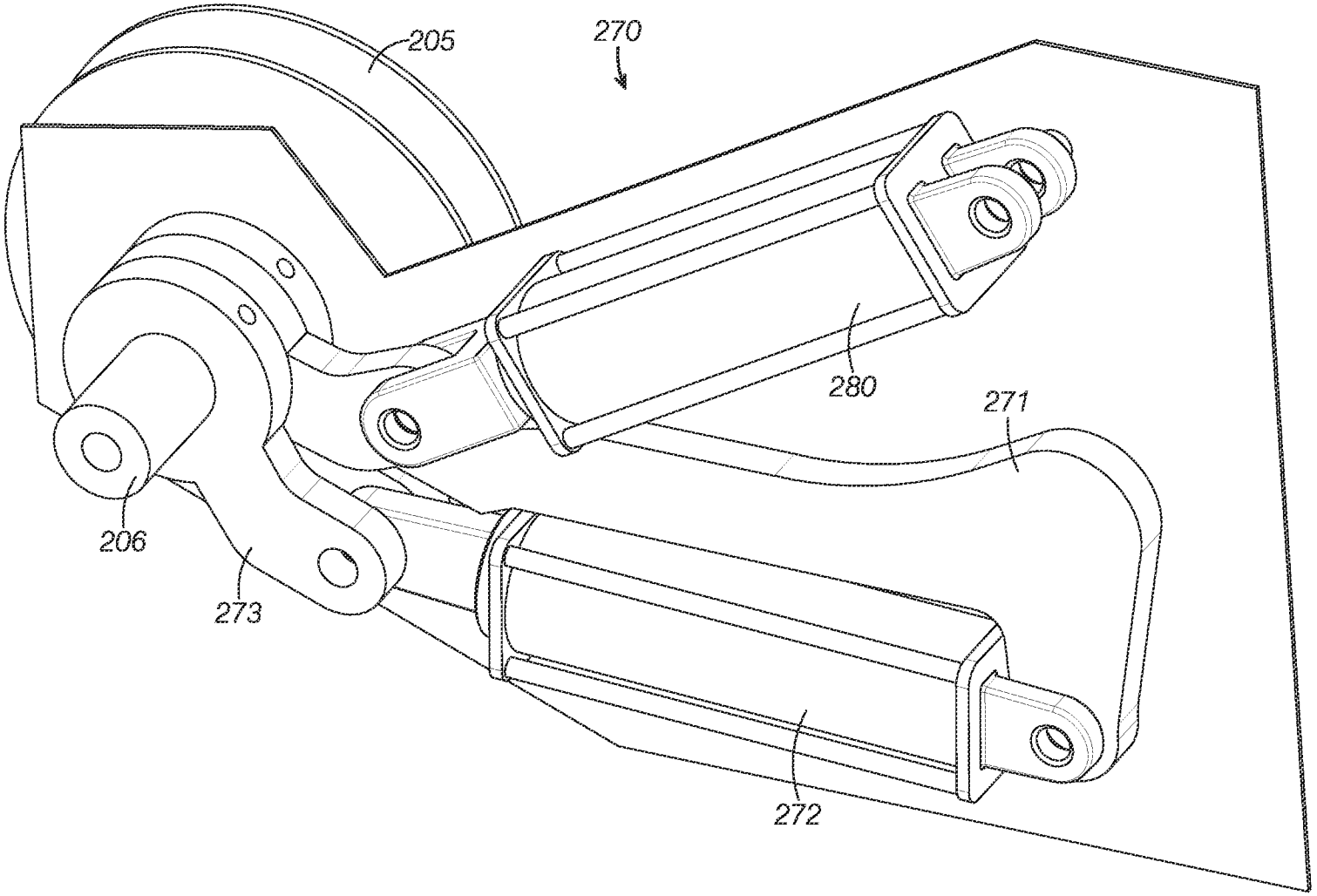
FIG. 12 is a perspective view of a second embodiment of a crank assembly.

The reader can see in FIGS. 2-4 that the links have different profiles in the present example. As shown in FIGS. 3 and 4, first link 171 has a bent profile. As can be seen in FIGS. 2-4, second link 173 has a straight profile. As can be seen in FIG. 12, in contrast to the straight profile of second link 173, second link 273 has a bent profile in crank assembly 270.

Device actuator 180 presses and retracts first link 171 to linearly act on crank assembly 170. Device actuator 180 is pivotally coupled to first link 171, which is pivotally connected to crank actuator 172. As shown in FIGS. 2-4 and 8-11, first link 171 includes three pivots whereas crank actuator 172 and second link 173 each include two pivots.

Crank actuator 172 is pivotally connected to first link 171 and to second link 173. Second link 173 is fixed to axle 106 of bending die 105. Crank actuator 172 is configured to actuate crank assembly 170 in conjunction with device actuator 180. In particular, crank actuator 172 is configured to extend and retract to rotate second link 173. Crank actuator 172 rotating second link 173 causes second link 173 to rotate axle 106.

Thus, crank assembly 170 selectively rotates bending die 105 when driven by device actuator 180. Crank assembly 170 is configured to rotate bending die 105 by more than 180 degrees. In particular, crank assembly 170 is configured to rotate bending die 105 from −2 degrees to at least 225 degrees. In some examples, crank assembly 170 is configured to rotate bending die 105 from degrees to 228 degrees in a single operation.

In the present example, crank actuator 172 is a linear actuator. In particular, crank actuator 172 is a hydraulic ram. However, the crank actuator may be any currently known or later developed type of actuator, such as electric linear actuators, pneumatic actuators, power screws, hydraulic rams, or combinations of actuators, rams, and/or screws. The reader will appreciate that a variety of actuator types exist and could be used in place of the crank actuator shown in the figures. In addition to the types of actuators existing currently, it is contemplated that the tube bending systems described herein could incorporate new types of actuators developed in the future.

In tube bending system 100, crank actuator 172 and device actuator 180 operate in coordination. As device actuator 180 extends to press first link 171, crank actuator 172 extends concurrently to press second link 173. In other examples, the crank actuator and the hydraulic ram operate independently, such as with selected delays or stages governing when each component operates relative to the other.

The size of the crank assembly may be varied as needed for a given application. In some examples, the crank assembly is larger relative to the other components than depicted in the figures. In other examples, the crank assembly is smaller relative to the other components than depicted in the figures. Further, the readier should understand that the crank assembly and the other components may all be larger or smaller than described herein while maintaining their relative proportions.

The crank assembly may be any currently known or later developed type of crank, including bell cranks. In some examples, the torque transmitting components include a square shaft, D-shaped shaft, a splined shaft, a bolted assembly, a cross pin, and/or a friction coupling, such as a compression collar or a conical interface. The reader will appreciate that a variety of crank types exist and could be used in place of the crank assembly shown in the figures. In addition to the types of cranks existing currently, it is contemplated that the tube bending systems described herein could incorporate new types of cranks developed in the future.

In the present example, the crank assembly is composed of metal. However, the crank assembly may be composed of any currently known or later developed material suitable for converting linear motion into rotational motion. Suitable materials include metals, polymers, ceramics, wood, and composite materials.

Frame

As shown in FIGS. 1-11, the role of frame 103 is to support components of tube bending system 100, including tube bending device 102, mandrel assembly 110, and wiper die assembly 115. The frame may be any currently known or later developed type of frame. The reader will appreciate that a variety of frame types exist and could be used in place of the frame shown in the figures. In addition to the types of frames existing currently, it is contemplated that the tube bending systems described herein could incorporate new types of frames developed in the future.

In the present example, frame 103 is composed of steel. However, the frame may be composed of any currently known or later developer material suitable for supporting components of the tube bending system. Suitable materials include metals, polymers, ceramics, wood, and composite materials.

The size of the frame may be varied as needed fora given application. In some examples, the frame is larger relative to the other components than depicted in the figures. In other examples, the frame is smaller relative to the other components than depicted in the figures. Further, the reader should understand that the frame and the other components may all be larger or smaller than described herein while maintaining their relative proportions.

Mandrel Assembly

The reader can see in FIGS. 4-6 that mandrel assembly 110 is disposed in tube 101 with a mandrel 111 proximate bending die 105. Mandrel assembly 110 functions to support tube 101 from inside tube 101 as tube 101 is being bent by tube bending device 102. Mandrel assembly 110 includes mandrel 111 and a rod 114.

As depicted in FIGS. 4-6, mandrel 111 is mounted to rod 114. Rod 114 extends from mandrel 111 away from tube bending device 102 and is used to remove mandrel 111 from inside tube 101 after tube 101 is bent by tube bending device 102.

The size of the mandrel may be varied as needed for a given application. In some examples, the mandrel is larger relative to the other components than depicted in the figures. In other examples, the mandrel is smaller relative to the other components than depicted in the figures. Further, the reader should understand that the mandrel and the other components may all be larger or smaller than described herein while maintaining their relative proportions.

The shape of the mandrel may be adapted to be different than the specific examples shown in the figures to suit a given application. For example, the mandrel may include a face having the shape of a regular or irregular polygon, such as a circle, oval, triangle, square, rectangle pentagon, and the like. Additionally or alternatively, the mandrel may include a face having an irregular shape. In three dimensions, the shape of the mandrel may be a sphere, a pyramid, a cone, a cube, and variations thereof, such as a hemisphere or a frustoconical shape.

The mandrel may be any currently known or later developed type of mandrel. In the present example, mandrel 111 is a unitary piece whereas in other examples the mandrel includes two or more links that articulate. The reader will appreciate that a variety of mandrel types exist and could be used in place of the mandrel shown in the figures. In addition to the types of mandrels existing currently, it is contemplated that the tube bending systems described herein could incorporate new types of mandrels developed in the future.

In the present example, mandrel 111 is comprised in part of bronze. However, the mandrel may be composed of any currently known or later developed material suitable for the applications described herein for which it is used. Suitable materials include metals, polymers, ceramics, wood, and composite materials.

Wiper Die Assembly

Wiper die assembly 115 functions to support the outside of tube 101 as it is being bent by tube bending device 102. Supporting the outside of tube 101 reduces wrinkles and other defects forming in tube 101 as it is bent.

As depicted in FIGS. 4-6, wiper die assembly 115 is mounted to frame 103 proximate tube bending device 102 and outside of tube 101. The wiper die assembly may be any currently known or later developed type of wiper die assembly. The reader will appreciate that a variety of wiper die assemblies exist and could be used in place of the wiper die assembly shown in the figures. In addition to the types of wiper die assemblies existing currently, it is contemplated that the tube bending systems described herein could incorporate new types of wiper die assemblies developed in the future.

The size of the wiper die assembly may be varied as needed for a given application. In some examples, the wiper die assembly is larger relative to the other components than depicted in the figures. In other examples, the wiper die assembly is smaller relative to the other components than depicted in the figures. Further, the reader should understand that the wiper die assembly and the other components may all be larger or smaller than described herein while maintaining their relative proportions.

Additional Embodiments

The discussion will now focus on an additional crank assembly embodiment. The additional embodiment includes many similar or identical features to crank assembly 170. Thus, for the sake of brevity, each feature of the additional embodiment below will not be redundantly explained. Rather, key distinctions between the additional embodiment and crank assembly 170 will be described in detail and the reader should reference the discussion above for features substantially similar between the different crank assembly examples.

Second Crank Assembly Embodiment

Turning attention to FIG. 12, a second example of a crank assembly, crank assembly 270, will now be described. As can be seen in FIG. 12, crank assembly 270 includes a first link 271, a crank actuator 272, and a second link 273. First is pivotally coupled to hydraulic ram 280, to axel 206, and to crank actuator 272. Both crank assembly 270 and crank assembly 170 function to convert linear motion from the device actuator into rotational motion acting on the bending die via two-stage actuation of pivotally connected actuators and linkages.

A distinction between crank assembly 270 and crank assembly 170 is that crank actuator 272 is a different style of hydraulic ram than crank actuator 172.

The first and second links of the two crank assemblies and their coupling arrangements are also different. For example, first link 171 pivotally couples to frame 103 and first link 271 pivotally couples to axel 206 instead. Another distinction is that second link 173 has a straight profile whereas second link 273 in FIG. 12 has a bent profile.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may claimed through amendment of those claims or presentation of new claims in the present application or a related application. Such amended or new claims, whether they are directed to the sane invention or a different invention and whether they are different, broader, narrower or equal in scope to the original claims, are to be considered within the subject matter of the inventions described herein.

The invention claimed is:

1. A tube bending device for bending a tube, comprising:
a device actuator;
a crank assembly mechanically coupled to the device actuator and including:
a first link pivotally coupled to the device actuator;
a crank actuator pivotally coupled to the first link; and
a second link pivotally coupled to the crank actuator:
a bending die mechanically coupled to the crank assembly; and
a clamp assembly operatively coupled to the bending die and configured to selectively secure the tube to the bending die;
wherein:
the device actuator selectively drives the crank assembly;
the crank assembly selectively rotates the bending die; and
the crank assembly is configured to rotate the bending die over at least 180 degrees.

2. The tube bending device of claim 1, wherein the second link is coupled to the bending die.

3. The tube bending device of claim 2, wherein:
the bending die includes an axle;
the second link is coupled to the axle.

4. The tube bending device of claim 3, where
the second link is pivoted by the crank actuator; and
the second link rotates the axle and the bending die when the second link is pivoted the crank actuator.

5. The tube bending device of claim 1 wherein the crank actuator is a hydraulic ram.

6. The tube bending device of claim 1, wherein:
the tube bending device is part of a tube bending system having a frame;
the first link is pivotally coupled to the frame.

7. The tube bending device of claim 6, wherein first link is pivotally coupled to the device actuator between where it is pivotally coupled to the frame and where it is pivotally coupled to the crank actuator.

8. The tube bending device of claim 1, wherein the first link has a bent profile.

9. The tube bending device of claim 8, wherein the second link has a straight profile.

10. The tube bending device of claim 1, wherein the device actuator is a linear actuator.

11. The tube bending device of claim 10, wherein the device actuator is a hydraulic ram.

12. The tube bending device of claim 10, wherein the crank assembly is configured to convert linear motion from the device actuator into rotational motion acting on the bending die.

13. The tube bending device of claim 1, wherein the bending die includes a curved outer circumference around which the tube bends as the bending die rotates.

14. The tube bending device of claim 13, wherein the bending die includes an axle mechanically coupled to the crank assembly.

15. The tube bending device of claim 13, wherein the bending die is circular.

16. The tube bending device of claim 1, wherein:
the bending die includes an axle;
the first link is coupled to the axle; and
the second link is coupled to the axle.

17. The tube bending device of claim 16, wherein the first link has a bent profile.

18. The tube bending device of claim 17, wherein the second link has a bent profile.

19. A tube bending device for bending a tube, comprising:
a device actuator;
a crank assembly mechanically coupled to the device actuator;
a bending die mechanically coupled to the crank assembly; and
a clamp assembly operatively coupled to the bending die and configured to selectively secure the tube to the bending die;

wherein:

the device actuator selectively drives the crank assembly;

the crank assembly selectively rotates the bending die;

the bending die includes an axle; and the crank assembly includes:

a first link pivotally coupled to the device actuator and coupled to the axle;

a crank actuator pivotally coupled to the first link; and a second link pivotally coupled to the crank actuator and coupled to the axle.

* * * * *